US011982516B2

(12) United States Patent
Stodolka et al.

(10) Patent No.: US 11,982,516 B2
(45) Date of Patent: May 14, 2024

(54) MOVABLE PROTECTION DEVICE FOR MILITARY VEHICLES WITH A DISTANCE-ACTIVE PROTECTION SYSTEM

(71) Applicant: KRAUSS-MAFFEI WEGMANN GMBH & CO. KG, Munich (DE)

(72) Inventors: Sascha Stodolka, Munich (DE); Jonas Otto, Munich (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 17/781,216

(22) PCT Filed: Dec. 8, 2020

(86) PCT No.: PCT/DE2020/101037
§ 371 (c)(1),
(2) Date: May 31, 2022

(87) PCT Pub. No.: WO2021/115534
PCT Pub. Date: Jun. 17, 2021

(65) Prior Publication Data

US 2023/0003489 A1 Jan. 5, 2023

(30) Foreign Application Priority Data

Dec. 10, 2019 (DE) ..... 10 2019 133 786.0

(51) Int. Cl.
*F41H 5/06* (2006.01)
*F41H 11/02* (2006.01)

(52) U.S. Cl.
CPC ..... *F41H 5/06* (2013.01); *F41H 11/02* (2013.01)

(58) Field of Classification Search
CPC ..... F41H 5/06; F41H 11/02
(Continued)

(56) References Cited

U.S. PATENT DOCUMENTS 3,590,685 A * 7/1971 Lane ..... F41H 5/14 109/49.5
4,358,984 A * 11/1982 Winblad ..... F41H 5/16 89/36.06

(Continued)

FOREIGN PATENT DOCUMENTS

DE 2219776 B2 1/1975
DE 10050479 A1 4/2002

(Continued)

OTHER PUBLICATIONS

European Patent Office (ISA/EP), International Search Report (with partial translation), International Application No. PCT/DE2020/101037, 5 pages, dated Mar. 10, 2021.

*Primary Examiner* — Samir Abdosh
(74) *Attorney, Agent, or Firm* — Thompson Hine LLP

(57) ABSTRACT

In exemplary embodiments, a device for protection of a military vehicle against repercussions from a distance-active protection system includes a protective shield pivotally attached to the vehicle that absorbs and/or redirects repercussions (e.g., shockwaves) from the distance-active protection system. A method for protecting a vehicle against repercussions of a distance-active protection system with a protection device. In other embodiments, the distance-active protection system is incorporated into a military vehicle.

17 Claims, 7 Drawing Sheets

(58) Field of Classification Search
USPC ..... 89/36.02
See application file for complete search history.

(56) References Cited

U.S. PATENT DOCUMENTS

| | | | | |
|---|---|---|---|---|
| 6,691,601 | B2 * | 2/2004 | Cohen | F41H 5/08 89/36.01 |
| 7,202,809 | B1 * | 4/2007 | Schade | F41H 11/02 89/1.816 |
| 7,341,002 | B1 * | 3/2008 | Baker | F42B 12/70 102/367 |
| 7,533,600 | B2 * | 5/2009 | Marqueling | F41H 5/16 89/36.09 |
| 8,006,606 | B1 * | 8/2011 | Petrosillo | F41H 5/18 89/36.07 |
| 8,539,873 | B2 * | 9/2013 | Gonard | F41H 5/023 89/937 |
| 9,086,255 | B1 * | 7/2015 | Berman | F41H 5/26 |
| 9,146,081 | B2 * | 9/2015 | Chu | F41H 5/013 |
| 9,605,929 | B1 * | 3/2017 | Handley | F41H 5/013 |
| 10,232,790 | B1 * | 3/2019 | Adrain | E05G 1/00 |
| 2009/0044695 | A1 * | 2/2009 | Benjamin | F41H 5/26 89/36.08 |
| 2019/0210538 | A1 * | 7/2019 | Adrain | B60R 7/14 |
| 2020/0393216 | A1 * | 12/2020 | Maji | F41H 5/02 |

FOREIGN PATENT DOCUMENTS

| | | | |
|---|---|---|---|
| DE | 102006048743 | A1 | 4/2008 |
| DE | 10 2008 039 512 | A1 | 2/2010 |
| DE | 102012106746 | A1 | 1/2014 |
| EP | 0687885 | A1 | 6/1995 |
| WO | 2019/002217 | A1 | 1/2019 |

* cited by examiner

Fig. 6a
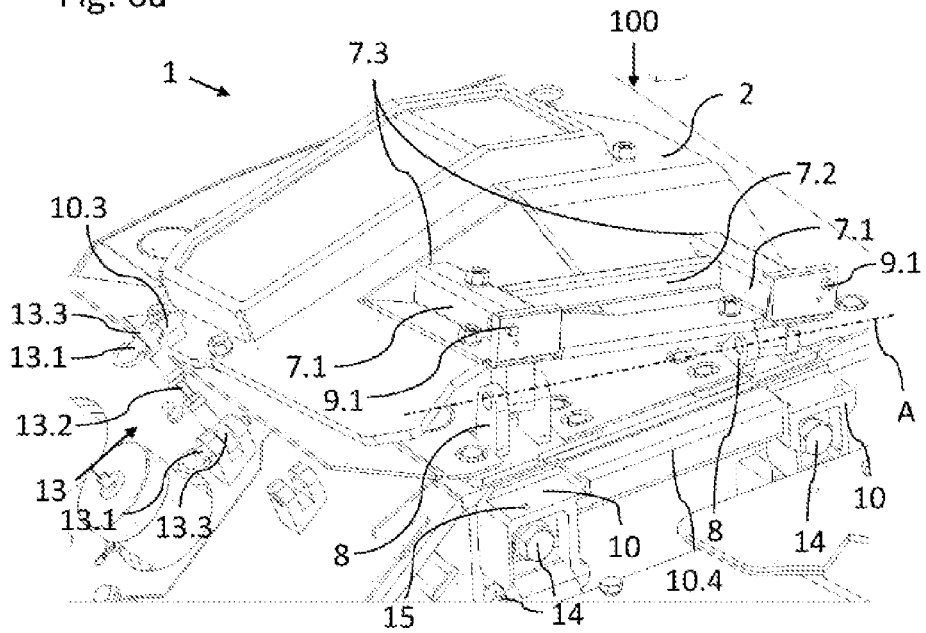
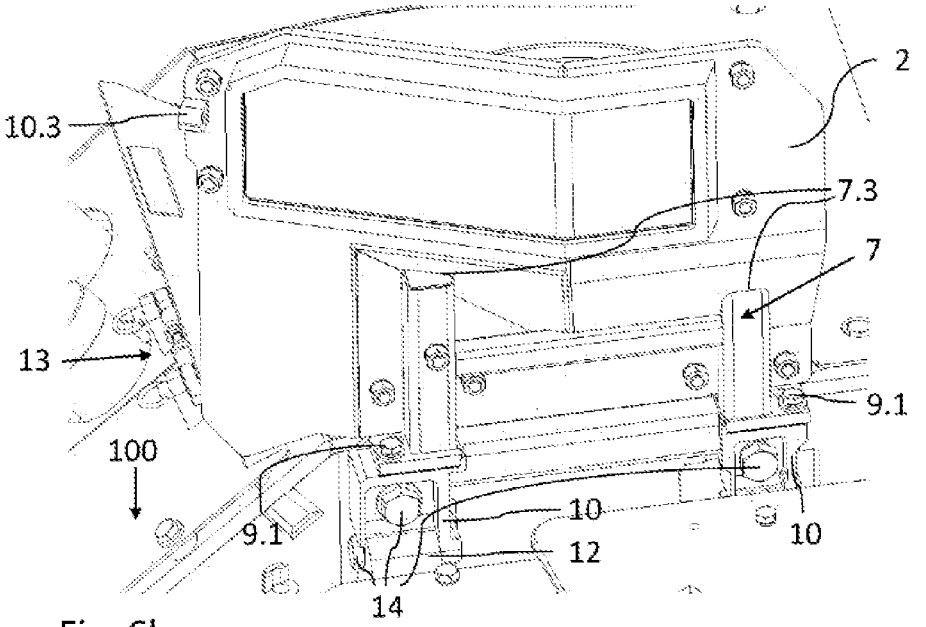
Fig. 6b

Fig. 8a
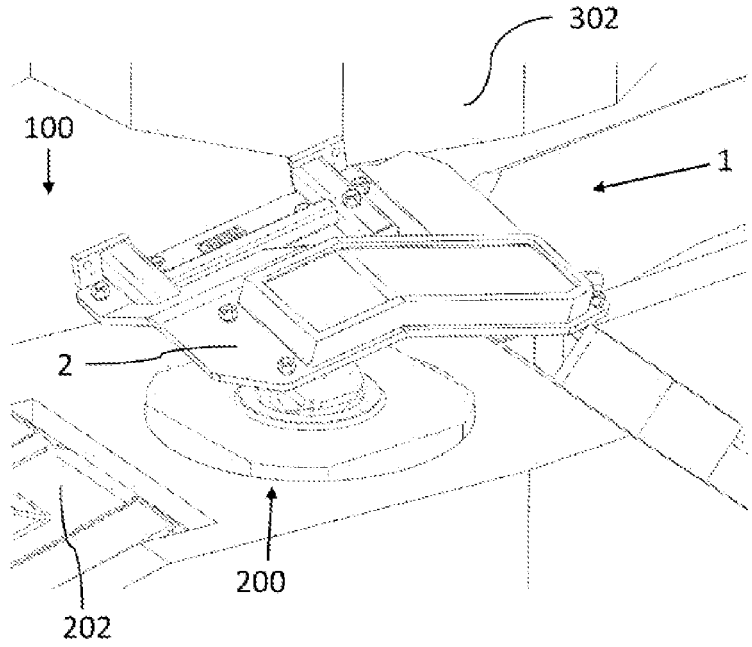
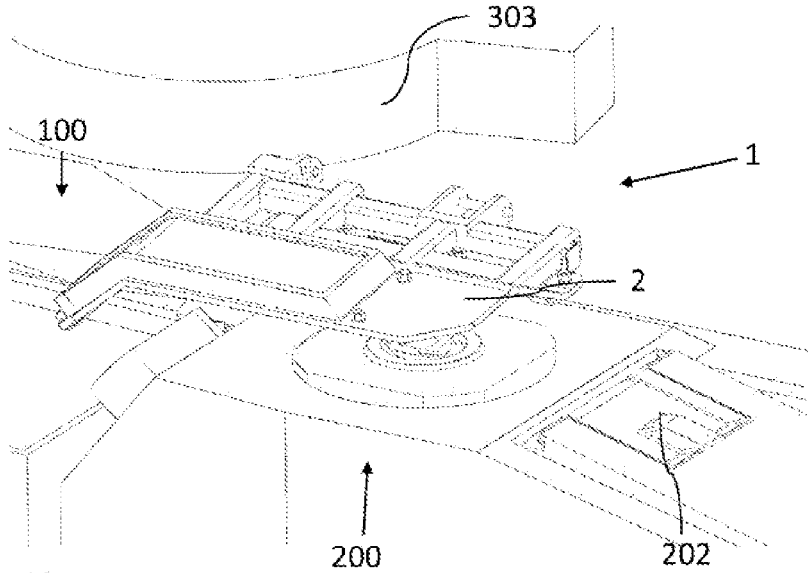
Fig. 8b

MOVABLE PROTECTION DEVICE FOR MILITARY VEHICLES WITH A DISTANCE-ACTIVE PROTECTION SYSTEM

TECHNICAL FIELD

The disclosure relates to a device for protection of a military vehicle against repercussions from a distance-active protection system on the vehicle. The device further relates to a method for protecting against repercussions of a distance-active protection system on a military vehicle with a protection device. A defense system with a distance-active protection system and a military vehicle with such a defense system form further objects of the device.

BACKGROUND

Distance-active protection systems, such as those described in Published European Patent Application No. EP 0 687 885 A1 or U.S. Pat. No. 7,202,809 B1, are used in military vehicles to defend against approaching threats.

Possible threats can be in particular approaching missiles or projectiles, which approach the military vehicle and destroy or at least damage it. Military vehicles are both land vehicles, such as tanks or off-road vehicles, as well as watercraft or aircraft, such as ships or helicopters.

If such a military vehicle has a distance-active protection system, then as with the invention, an approaching threat can also be detected and a corresponding countermeasure initiated. To defend against the threat, it can be shot at in particular by the distance-active protection system, for example by projectile-forming charges or hollow body projectiles, so that the threat is already destroyed in the air at a distance from the vehicle and damage to the vehicle is avoided.

Thus, although the use of a distance-active protection system reduces the effects of an approaching threat on a military vehicle, the use of the protection system itself causes repercussions on the vehicle to be protected, so that in particular turret superstructures, such as in particular optics, crew members and/or other less armored elements can be damaged by the repercussions. The repercussions of the distance-active protection system, for example blasts or projectile residues, result from the bombardment of the approaching threat, since when a projectile is fired as a countermeasure, repercussions occur simultaneously, in particular against the direction of fire, which can then act on the military vehicle.

In the prior art, distance-active protection systems are therefore arranged in such a way that their repercussions cannot have an effect on the military vehicle, but "bypass" the vehicle. European Published Patent Application No. EP 0 687 885 A1, for example, arranges the distance-active protection system on an obliquely positioned, oblong mounting arm on the vehicle, so that there is a clear distance between the vehicle and the protection system. In U.S. Pat. No. 7,202,809 B1, on the other hand, the distance-active protection system is arranged directly on the highest point of the military vehicle, so that the repercussions of the distance-active protection system also bypass the vehicle.

Even though the military vehicle can thus be protected from repercussions of the distance-active protection system, in an unfavorable way in the solutions of the prior art an excessive increase in the vehicle contour of the military vehicle results from the arrangement of the distance-active protection system on a mounting arm or at the highest point of the vehicle. However, such an increase in the contour of the vehicle can prove to be disadvantageous and limit the possible applications of the military vehicle.

For example, military vehicles often have to be loaded and transported, wherein an increase in the vehicle structure requires additional transport volume. Furthermore, when driving the military vehicle, an enlarged vehicle contour may be disadvantageous, for example, when crossing terrain or in underpasses.

SUMMARY

The disclosed distance active protection system is therefore based on the object of creating a protection device which reduces an enlargement of the vehicle contour of a military vehicle due to a defense system.

This object is achieved with a protection device of the type mentioned at the beginning in that a protective shield can be movably, in particular pivotally, attached to the vehicle by means of a fastening device.

The protection device may serve to protect the military vehicle with the distance-active protection system against its repercussions, in particular against blasts and/or projectile residues. It can be arranged directly on the vehicle. Due to the design according to the invention and the associated protective effect, the distance-active protection system can also be arranged directly on the vehicle compared to the known solutions from the prior art, wherein a distance from this, in particular on its highest point or by means of a mounting arm, is no longer absolutely necessary. Due to the direct arrangement of the protection device and the associated possibility of the direct arrangement of the distance-active protection system on the vehicle, this results in a reduced vehicle contour.

The protection device may have a protective shield, which can be movably attached to the vehicle by means of a fastening device. The protective shield can absorb and/or redirect the repercussions of the distance-active protection system so that they do not act directly on the vehicle. The fastening device can be used for the attachment and movability of the protective shield, wherein it can be designed as a kind of interface between the vehicle and the protective shield. Due to the movability of the protective shield, the vehicle contour, especially outside of operations, can be additionally reduced, so that the possible applications are not limited here due to the protection device.

An advantageous design provides that the protective shield can be moved from a parking position to an operating position. While in the parking position the vehicle contour can be reduced, especially compact, whereas in the operating position the protective shield can protect against repercussions of the distance-active protection system on the vehicle. The dismantling of the protection device, in particular the protective shield, outside of operations and the subsequent assembly thereof can thus be avoided due to the movability. In addition to the parking position and the operating position, however, other positions of the protective shield may also be provided, such as an intermediate position, which can be located in particular between the parking position and the operating position. In this context, it is also possible that when the protective shield is being transferred from the operating position to the parking position, the protective shield can be moved out of a field of view, in particular a field of view of optics and/or a crew member. As a result, the field of view can be increased accordingly.

In this context, it may also be provided that the movement of the protective shield from the parking position to an operating position is done manually, for example by a crew member, by hydraulics and/or by a drive, for example by a motor. Conversely, the protective shield can also be moved from the operating position to the parking position. In order to maintain the position of the protective shield after moving to the desired position, it can be suitably locked.

A further advantageous design provides for at least one locking element for locking the protective shield in different positions of the protective shield. Such a locking element can be designed as a captive plug-in bolt or a captive screw bolt and can lock the protective shield in the various positions, in particular in the parking position and the operating position, so that the protective shield is held in the desired position. In the design and arrangement of the locking element, it is possible that the same locking element can lock the protective shield in all its positions, for example by moving this locking element with the protective shield. Alternatively, however, it is also possible that multiple locking elements may be provided, each of which locks the protective shield in a different position, so that, for example, a first locking element locks the protective shield in the parking position and a second locking element locks the protective shield in the operating position.

Since the protective shield can restrict the view of crew members and/or optics due to the arrangement on the vehicle, in particular in the operating position, the protective shield advantageously has at least one viewing window for looking through the protective shield. Especially in the operating position, the protective shield can reduce the field of view of crew members and/or optics, so that the viewing window allows a view through the protective shield, even if it were in the field of view. In this context, it is possible that the viewing window is made of bulletproof glass, so that protection against repercussions can also be provided in the area of the viewing window. When designing the viewing window, it is also possible to design the viewing window as a viewing block. Furthermore, it is also conceivable to adapt the viewing window to the design of the protective shield, in particular any angular designs, for example by designing the viewing window at an angle.

An advantageous design in this context provides that the viewing window is arranged replaceably in the protective shield. This means that the viewing window can be replaced if necessary, for example if the transparency is reduced due to dirt or damage to the viewing window. This can occur especially because the repercussions of the distance-active protection system can, among other things, act on the viewing window and can foul and/or damage it accordingly. Due to the replaceability of the viewing window, however, the protective shield can be retained and just the viewing window can be replaced if necessary. It is also possible due to the rapid replaceability to adapt the viewing window depending on the purpose.

With reference to the viewing window, it is further proposed as an advantageous development that the protection device has vibration protection to protect the viewing window against vibrations. This vibration protection can be designed as a damper and/or as a support. Regardless of the position of the protective shield, vibrations can act on the protective shield and thus in particular on the viewing window when the military vehicle is used, for example when driving or in battle. Due to these vibrations, the transparency through the viewing window can be impaired, especially worsened. Furthermore, these vibrations may damage the viewing window. In order to counteract impaired transparency and/or damage to the viewing window, vibration protection can protect the viewing window from vibrations, in particular by dampening them.

With regard to the protective properties of the protection device, a further particularly advantageous design of the invention provides that the protective shield is designed at an angle to deflect the repercussions of the distance-active protection system. Here, the angular design of the protective shield can not only enable the protection of the military vehicle from the repercussions of the distance-active protection system, but also that repercussions can be diverted away from the military vehicle, so that they no longer act primarily towards the vehicle and thus the protective effect can be increased. In connection with the geometry of the protective shield, it is also possible to design the protective shield so that its geometry can be expanded. Thus, it would be particularly advantageous to adapt the geometry of the protective shield to the respective purpose, for example by adjusting the size and/or the shape and/or the angular design, in particular the angular position, of the protective shield.

In order to attach the protective shield movably by means of the fastening device, a particularly advantageous design provides that the fastening device has at least one hinge for the movement of the protective shield. The hinge may be formed as a pivot hinge for pivoting, for example a hinge joint or a ball joint, and/or as a sliding hinge for moving the protective shield. The at least one hinge can allow the movement of the protective shield in its different positions by connecting the protective shield to the military vehicle by means of the hinge. Due to the at least one hinge, it is possible that the protective shield is independently movable relative to the distance-active protection system. For example, it is possible that the protective shield is moved to an operating position and remains fixed therein, while the distance-active protection system orients itself accordingly and bombards threats approaching the vehicle.

In an advantageous manner, it is further provided with regard to the fastening device that the fastening device has a carrier device for carrying the protective shield. The carrier device can carry the protective shield and can accordingly absorb its load. It is possible that the carrier device can be moved with it when the protective shield moves, so that the relative position between the carrier device and the protective shield remains the same. However, it is also possible that the carrier device cannot be moved and thus the relative position between the carrier device and the protective shield changes accordingly during its movement.

Furthermore, an advantageous design of the protection device provides at least one support for supporting the protective shield. This support can support the protective shield as soon as repercussions of the distance-active protection system act thereon, so that it withstands the repercussions. It is advantageous in this context if the support itself is formed as part of the fastening device, in particular as part of the carrier device. Furthermore, a plurality of supports may also be provided for a greater supporting effect, wherein it would be possible to connect these to each other by means of at least one support arranged transversely thereto, so that the supporting effect is additionally increased.

In order for the protective shield to be supported by the fastening device, a further advantageous design provides that at least one stop is designed in such a way that in the event of repercussions of the distance-active protective system, at least a part of the repercussions acting on the protective shield is absorbed by the fastening device by means of the at least one stop. The stop may be designed as part of the fastening device, in particular as part of the carrier device or the support. In order to absorb at least some of the repercussions acting on the protective shield, the stop may be in contact with the protective shield. The contact can exist either at any time in the form of a fixed connection, in particular a welded joint, or only in the event of repercussions, in particular if the protective shield merely rests on the stop.

As a further advantageous design, at least one sensor is provided for detecting at least one position of the protective shield, in particular the parking position and/or the operating position. The sensor can be used to detect the position of the protective shield, as it can take different positions due to its movability, wherein the respective position generally depends on the intended use. The sensor may be designed as an active or passive sensor, in particular as a proximity sensor or position sensor or as a switch, in particular as a limit switch.

A further advantageous design in this context provides for a control unit for processing the sensor data. The detected sensor data can be processed by the control unit and then reused. Thus, it is possible to display the processed sensor data to the crew via an interface by means of the control unit and/or to transmit the processed sensor data to other systems of the military vehicle. The tasks of the other systems can then be carried out taking into account the sensor data. It is also possible in this context that the control unit can be coupled to a drive and/or to hydraulics for the movement of the protective shield, so that this control unit can control the movement accordingly. Here it would be possible to make the control unit operable by a crew member.

In addition to the protection device according to the invention, it is also proposed in a defense system with a distance-active protection system for the protection of a military vehicle for the achievement of the aforementioned object that this has a protection device having one or more of the aforementioned features. This results in the advantages explained in connection with the protection device.

An advantageous design of the defense system provides that the protective shield in the parking position serves as a cover for the distance-active protection system. In this context, it is possible that the protective shield in the parking position can cover the distance-active protection system and thus protect it from external influences. Especially in transport situations, for example when loading the military vehicle, possible damage to the protection system can be counteracted. It is also possible that the protective shield cannot cover the entire distance-active protection system, but that the cover can only extend to a part of it, in particular to a part of the protective system remaining on the vehicle when the countermeasure is dismounted. Furthermore, it is also possible that the protective shield in the parking position cannot cover any part of the distance-active protection system, in particular if this is moved away from the distance-active protection system when moving from the operating position to the parking position.

A further advantageous design provides that the distance-active protection system is coupled to the protection device in such a way that the distance-active protection system can only be used in one of several possible positions of the protective shield, in particular the operating position. The coupling of the protective system to the protection device can then ensure that the protective system can only be used if the protective shield is in a certain position, in particular the operating position. In particular, since the protection against the repercussions of the distance-active protection system can only be fully guaranteed by the protection device if the protective shield is in the operating position, this coupling can increase the operating safety of the protection device. In this context, it would be possible for such a coupling to be controlled by a control unit. It is possible that the protective shield remains in one position, in particular the operating position, while the distance-active protective system moves relative to the protective shield. For example, the protective shield can be pivoted into a position and locked in it, especially in the operating position. The distance-active protection system can then aim at and shoot at an approaching threat by orientation, e.g. by a rotational movement.

Advantageously, the protective shield is movable, in particular pivotable, independently of the distance-active protection system. It is possible that the distance-active protection system is movable, in particular rotatable, independently of the protective shield.

In addition, in the case of a military vehicle of the type mentioned above, for the achievement of the aforementioned object it is further proposed that it has a defense system with one or more of the aforementioned characteristics. This results in the advantages explained in connection with the defense system or with the protection system.

An advantageous design of the military vehicle provides that the protection device can be arranged on a line between the distance-active protection system and an object to be protected of the military vehicle. This arrangement can ensure that in the event of repercussions of the distance-active protection system towards the object to be protected, the protection device can absorb and/or redirect these repercussions, so that the repercussions are kept away from the object, and accordingly this is protected. It is possible that the distance-active protection system is rotationally movable for bombarding an approaching threat, while the shield can be fixedly locked in the operating position. Even with a moving distance-active protection system, this makes it possible for the protective shield to be arranged in the operating position on a line between the distance-active protection system and the object to be protected. The protective shield may be fixed in the operating position relative to the vehicle, while the distance-active protective system moves relative to the protective shield.

In a method for protecting against repercussions of a distance-active protection system on a military vehicle with a protection device, it is proposed that a protective shield is moved, in particular pivoted, to achieve the aforementioned object.

The advantages explained in connection with the protection device result here. The features described in connection with the protection device may also occur individually or in combination with the method. The described advantages result.

With regard to the method, it has proven to be advantageous that the protective shield is moved to an operating position to enable shooting by the distance-active protection system. In the operating position of the protective shield, the protection device protects the vehicle from repercussions of the distance-active protection system. Since in the parking position of the protective shield the protective effect against repercussions may be correspondingly reduced, coupling of the distance-active protection system and the protection device, in particular the protective shield, may be advantageous. Here it is possible to carry out the coupling in such a way that the protection system can only be enabled and accordingly activated when the protective shield is in the operating position.

In an advantageous manner, it may also be provided in connection with the method that the protective shield is moved to a parking position to block shooting of the distance-active protection system. Since the protective effect of the protection device may be reduced in the parking position, coupling of the distance-active protection system and the protection device may be advantageous. The coupling may provide that the distance-active protection system is deactivated when the protective shield is transferred to the parking position and the shooting function is blocked accordingly.

With regard to the method, it has also proven to be advantageous if, before the use of the distance-active protection system, a protective shield is moved, in particular pivoted, from a parking position to an operating position to protect against repercussions of the distance-active protection system on the vehicle. Outside of operations, the protective shield can be moved to the parking position, since outside of operations the use of the distance-active protection system is generally not provided. In the parking position, the protective shield can reduce the contour of the vehicle, so that the aforementioned advantages occur. If, on the other hand, the military vehicle is in use, wherein the use of the distance-active protection system may be provided, the protective shield may be moved from the parking position to the operating position in order to protect the vehicle from repercussions of the distance-active protection system.

BRIEF DESCRIPTION OF THE DRAWINGS

Further details and advantages of protection devices according to the invention, defense systems equipped with such protection devices, military vehicles equipped with such defense systems and methods according to the invention are explained below by way of example on the basis of the figures. In the figures:

FIGS. 6*a* and 6*b* show a further protection device movably attached to a vehicle in a parking position and in an operating position.

DETAILED DESCRIPTION

Figure 1:
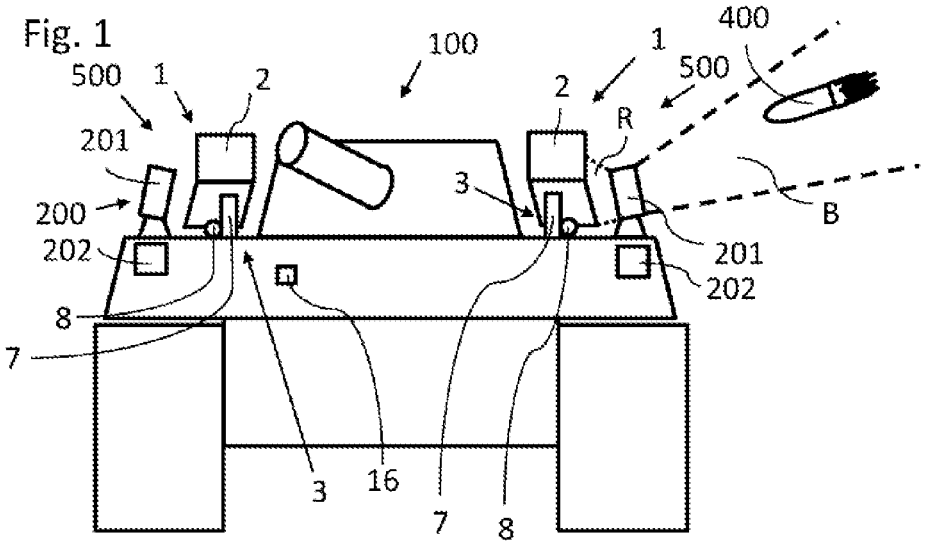
FIG. 1 shows a schematized representation of a military vehicle with a distance-active protection system and a protection device according to the invention in a front view of the vehicle, wherein the protective shield is located in the operating position.
Figure 2:
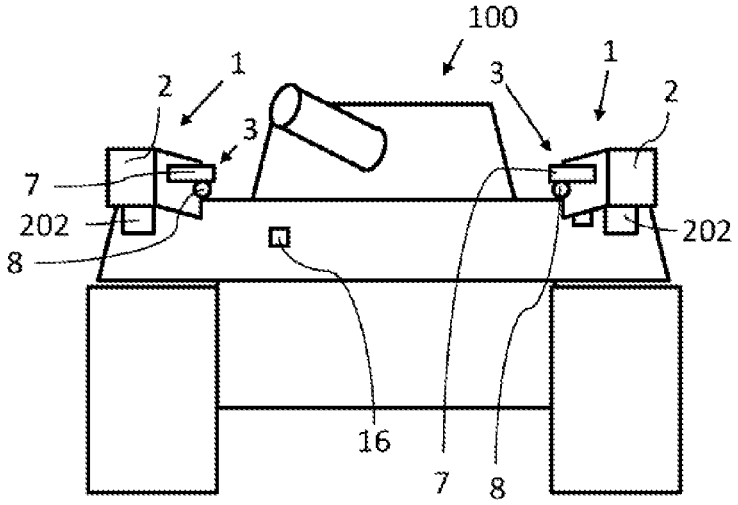
FIG. 2 shows a schematized representation of the military vehicle according to FIG. 1, wherein the protective shield is located in the parking position.

FIGS. 1 and 2 show schematic representations of a military vehicle 100 with a distance-active protection system 200 and a protection device 1 according to the invention on each side of the vehicle 100.

Although the military vehicle 100 in the representations here is a tank, other land vehicles, such as off-road vehicles, or also watercraft or aircraft, such as ships or helicopters, which have a distance-active protection system 200, can also be equipped with a corresponding protection device 1.

The protection device 1 and the distance-active protection system 200 are components of a defense system 500. The defense system 500 serves, among other things, on the one hand to protect the vehicle 100 from possible approaching threats 400, in that the distance-active protection system 200 can shoot at and destroy them accordingly, and on the other hand to protect the vehicle 100 from repercussions R of the distance-active protection system 200 occurring as a result of the bombardment B of the threats 400.

The distance-active protection system 200 has a countermeasure 201, which is loaded by means of a loading device 202 of the protection system 200. The charges, in particular projectiles, projectile-forming charges or hollow body projectiles, of the countermeasure 201 are used to bombard B approaching threats 400, as shown schematically in FIG. 1.

According to FIG. 1, the protection device 1 has a protective shield 2 and a fastening device 3, which movably attaches the protective shield 2 to the vehicle 100. The fastening device 3 has a carrier device 7 for carrying the protective shield 2 and a hinge 8 for the movement of the protective shield 2.

The protective shield 2 is in an operating position according to the representation, so that it can protect the military vehicle 100 from possible repercussions R of the distance-active protection system 200. The protective shield 2 is set up in such a way that the area of the vehicle 100 is covered by the protective shield 2 starting from the countermeasure 201 to the middle of the vehicle 100, so that this area is protected accordingly against repercussions R of the distance-active protection system 200. While the protective shield 2 is arranged vertically in the operating position in this implementation, other orientations of the protective shield 2 in the operating position are also possible.

If, as FIG. 1 schematically depicts, a threat 400, for example in the form of a steerable missile or a projectile, approaches the vehicle 100 in order to destroy or damage it, the threat 400 is detected by the distance-active protection system 200 and shot at by its countermeasure 201. By means of the bombardment B, the threat 400 is destroyed at a distance from the vehicle 100.

During the bombardment B by the countermeasure 201, however, repercussions R occur at the same time, such as in particular blasts or projectile residues, which act opposite to the direction of shelling and thus towards the vehicle 100. In order to protect the military vehicle 100 against these repercussions R, these are suitably absorbed by means of the protection device 1 and in particular its protective shield 2 and at least partially deflected, so that the vehicle 100 is correspondingly protected.

Outside of operations, the protective shield 2 may be in a parking position, as shown schematically in FIG. 2. In the parking position, the protective shield 2 is accordingly folded down to the side of the vehicle, wherein folding inwards is also possible as an alternative. In the implementation, the protective shield 2 is oriented horizontally in the parking position, wherein alternatively other orientations of the protective shield 2 are quite possible in the parking position.

In order to transfer the protective shield 2 from the operating position according to FIG. 1 to the parking position according to FIG. 2, the countermeasure 201 is dismounted accordingly so that the protective shield 2 can be pivoted. However, it would also be conceivable here that the countermeasure 201 remains mounted on the vehicle 100 and the protective shield 2 in the parking position covers at least part of the distance-active protection system 200 and thus acts as a kind of cover or lid. It is also possible to arrange the protection device 1 on the vehicle 100 in such a way that the countermeasure 201 is not covered in the parking position of the protective shield 2, for example when the protective shield 2 is pivoted inwards.

When looking at the different positions of the protective shield 2 of FIGS. 1 and 2, it becomes apparent that the contour of the vehicle 100 can be reduced in the parking position of the protective shield 2 compared to the contour of the vehicle 100 with the protective shield 2 in the operating position.

Various embodiments of the protection device 1 will be explained below in more detail on the basis of FIGS. 3 to 6.

Figure 3A:
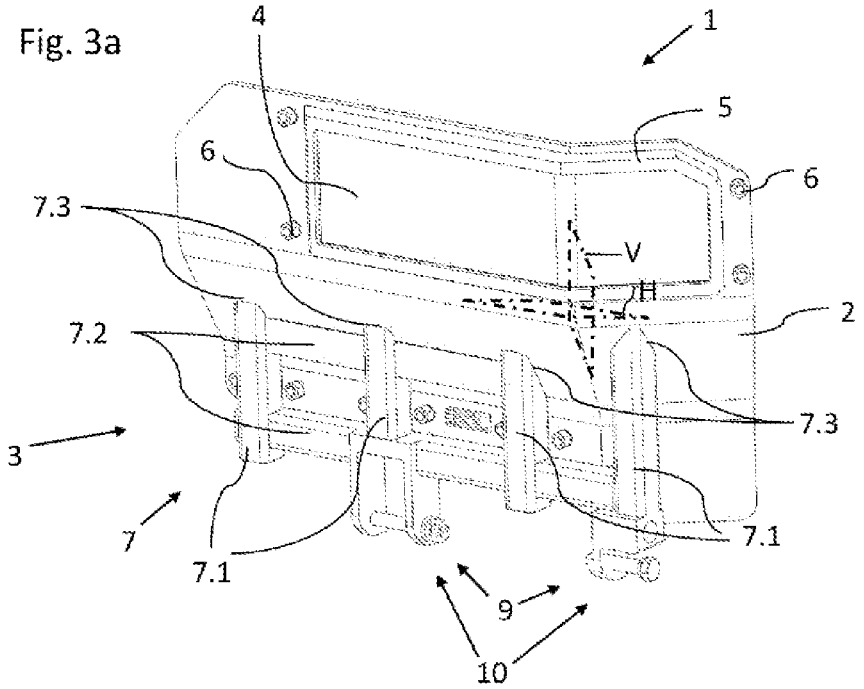
FIGS. 3*a* and 3*b* show an embodiment of the protection device according to the invention in two views.
Figure 3B:
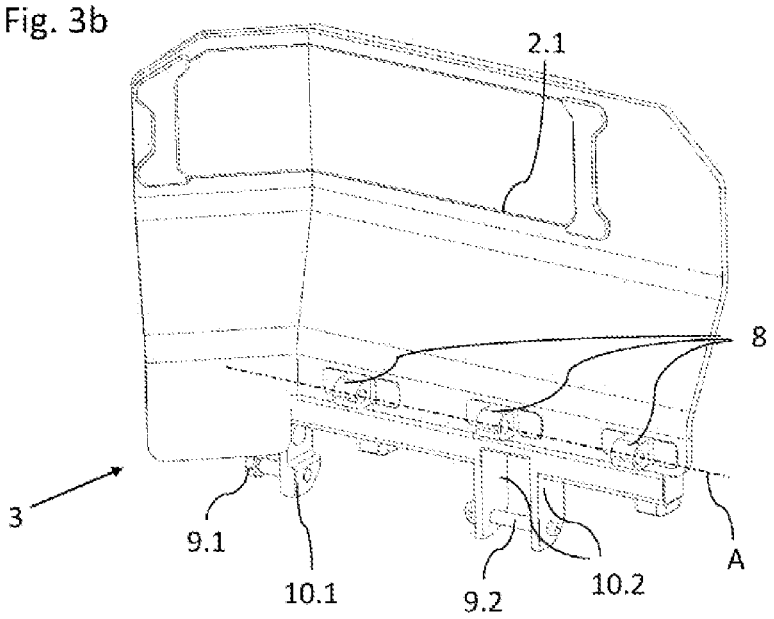

FIGS. 3*a* and 3*b* show a first exemplary embodiment of the protection device 1 in two different perspectives. The protection device 1 has a protective shield 2 and a fastening device 3, wherein the fastening device 3 is used for the movable attachment of the protective shield 2 to a military vehicle 100.

The protective shield 2 is designed at an angle in both a horizontal plane H and a vertical plane V. The angular design can advantageously cause repercussions R of a distance-active protection system 200 to be correspondingly deflected by the protective shield 2 and thus that the vehicle 100 can be protected, as is shown in FIG. 1. However, taking into account the intended use or the available installation space on the vehicle 100, it is also possible to design the configuration of the protective shield 2 differently. For example, the protective shield 2 can also be designed completely flat and without angular areas or with a different number of angular areas in a horizontal plane H and/or a vertical plane V. However, the possible angles here are not limited to the horizontal plane H and/or the vertical plane V but can also be oriented differently.

The protective shield 2 has a viewing window 4 for looking through it. The viewing window 4 may be particularly advantageous if the protective shield 2, for example, reduces the field of view of an optical arrangement and/or a crew member of the military vehicle 100. According to the embodiment the viewing window 4 is manufactured of bulletproof glass, so that in addition the area behind the viewing window 4 is also correspondingly protected against the repercussions of the distance-active protection system 200.

The viewing window 4 is arranged in front of a shield recess 2.1 of the protective shield 2 by means of a frame 5. For the arrangement, the viewing window 4 is positioned between the frame 5 and the protective shield 2 and in front of the shield recess 2.1 and is fixed by screwing the frame 5 to the protective shield 2 by means of multiple screws 6. Due to this arrangement, the viewing window 4 is replaceable and accordingly can be replaced if necessary, for example if it is damaged or the view is impeded.

In order to ensure the view through the viewing window 4 even in the event of vibrations occurring, which may occur in particular while driving the vehicle 100 or during use of the distance-active protection system 200, vibration protection which is not shown is provided in the frame 5. Especially if the viewing window 4 is made of bulletproof glass, vibrations can lead to reduced transparency if the viewing window 4 were also to vibrate. Furthermore, the vibration protection can prevent damage to the viewing window 4 due to occurring vibrations, which can occur, for example, when driving the military vehicle 100 or due to the distance-active protection system 200. In order to avoid the transmission of vibrations to the viewing window 4, the vibration protection can be designed as a damper.

For the movable attachment of the protective shield 2 to the military vehicle 100, the protection device 1 has the fastening device 3. The fastening device 3 allows the movement of the protective shield 2 between different positions, such as in particular between a parking position and an operating position.

The fastening device 3 has a carrier device 7, which carries the protective shield 2. The carrier device 7 is composed of four supports 7.1 which are vertical in the illustrations and two supports 7.2 which are horizontal in the illustrations, wherein the horizontal supports 7.2 are not formed contiguously, but are divided into multiple subsections. The supports 7.1, 7.2 are arranged in a lattice structure, running transversely. The supports 7.1, 7.2 are used to support the protective shield 2, in particular once repercussions R of the distance-active protection system 200 occur, wherein the lattice structure can cause an advantageous force application and force distribution in the supports 7.1, 7.2 or in the fastening device 3. However, different embodiments, in particular taking into account the intended use of the protection device 1, are also possible here. For example, the number of supports 7.1, 7.2 and/or the angles between the junctions of supports 7.1, 7.2 and/or the design of supports 7.1, 7.2 could be varied. Furthermore, it is also possible to design the supports 7.1, 7.2 not as part of the carrier device 7, but as separate components of the protection device 1.

The carrier device 7 also has a total of four stops 7.3, wherein a different number is also possible, which are designed as part of the vertical supports 7.1. By means of the stops 7.3, the carrier device 7 is connected to the protective shield 2. The connection is designed to be inseparable, for example by welding, but can alternatively be designed to be detachable, for example by screwing. The connection between the protective shield 2 and the carrier device 7 allows the at least partial introduction of the repercussions R from the protective shield 2 into the carrier device 7, in particular into the vertical supports 7.1, via the stops 7.3.

For the movement of the protective shield 2, the fastening device 3 has three hinges 8. The hinges 8 are attached to a first side of the protective shield 2 and can be attached on the opposite side to the military vehicle 100, so that the protective shield 2 can be moved, here pivoted, by means of the hinges 8. The movement of the hinges 8 takes place around an axis A, wherein the protective shield 2 is accordingly moved around this axis A. Since the axis A results from the arrangement of the hinges 8, a different arrangement of the hinges 8 from the exemplary embodiment, for example on the carrier device 7, is also possible. In particular, against the background of the available installation space for the protection device 1 on the vehicle 100, a differently oriented axis A may well be advantageous, for example if the protection device 1 and in particular its protective shield 2 must be pivoted past a body of the vehicle 100.

The protective shield 2 can be movably attached to the vehicle 100 by means of the fastening device 3 in that the carrier device 7 and the connected protective shield 2 are also moved when the hinges 8 move. For the implementation according to FIGS. 3*a*, 3*b*, the carrier device 7 is moved with the protective shield 2.

As an alternative, it is also possible to arrange the hinges 8 not on the protective shield 2, but on the carrier device 7. In this case, when the carrier device 7 moves, the protective shield 2 would be moved if there is a fixed connection between the protective shield 2 and the carrier device 7.

The fastening device 3 also has two locking elements 9 for locking the protective shield 2 in different positions. According to the implementation, the locking elements 9 may be formed as captive screw bolts 9.1 or captive plug bolts 9.2.

The locking elements 9 allow the protective shield 2 to be immovably lockable in different positions relative to the vehicle 100. The distance-active protection system 200, in particular the countermeasure 201, can aim at an approaching threat 400, for example by a rotational movement, while the protective shield 2 remains unmoved in the respective position.

As a counterpart to the locking elements 9, the fastening device 3 has two locking holders 10. The locking holders 10 are essentially fork-shaped, wherein the first locking holder 10.1 has only one fork arm and the second locking holder 10.2 has two opposite fork arms. The fork arm of the first locking holder 10.1 has a threaded bore to accommodate the screw bolt 9.1, the fork arms of the second locking holder 10.2 each have a bore. To lock the protective shield 2 in one position, the locking elements 9 are inserted, in particular plugged or screwed, into the locking holders 10 according to the illustrations in FIGS. 3*a* and 3*b*. The locking holders 10 are designed as part of the carrier device 7, here in particular as part of the vertical supports 7.1.

Figure 4A:
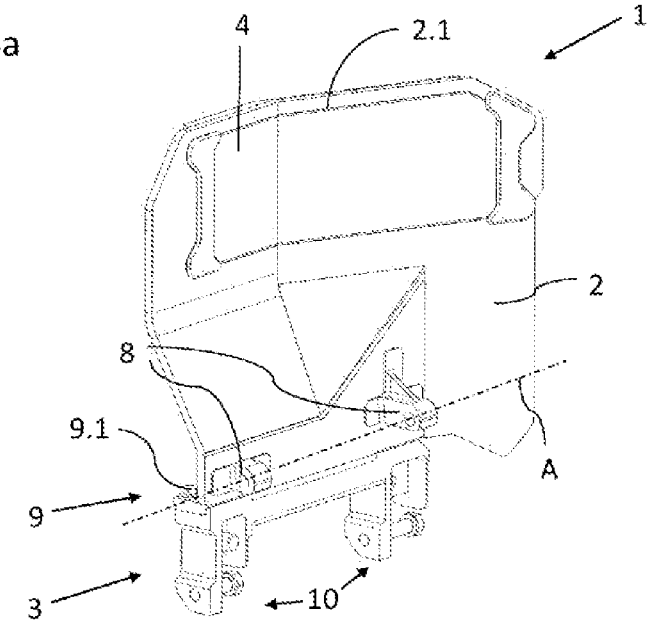
FIGS. 4*a* and 4*b* show a further embodiment of the protection device according to the invention in two views.
Figure 4B:
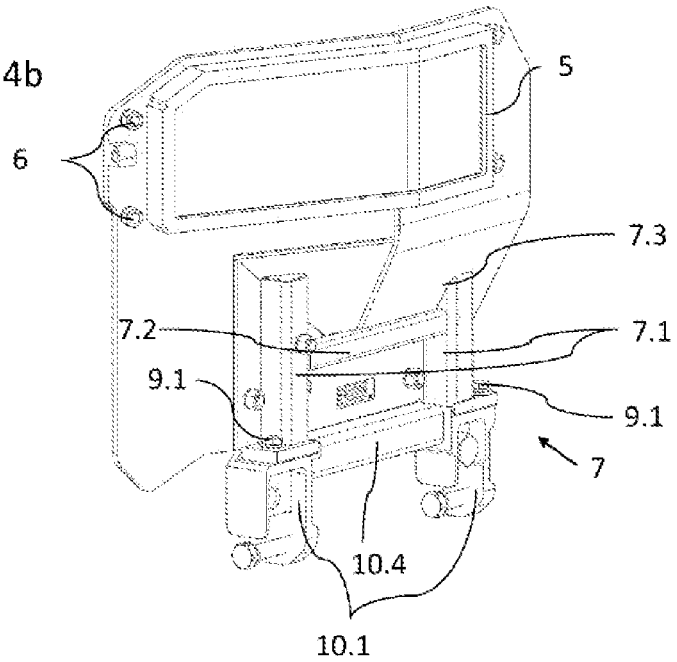

In FIGS. 4*a* and 4*b* a further exemplary embodiment of the protection device 1 is illustrated. The protection device 1 has the essential features of the first implementation according to FIGS. 3*a* and 3*b*, so that the differences between the two implementations are addressed in particular. However, the advantages of the first implementation mentioned above also apply to this second implementation and are by no means excluded by the subsequent discussion of the differences.

The protection device 1 according to FIGS. 4*a* and 4*b* has a protective shield 2 which is movable by means of a fastening device 3, which, however, is designed with different dimensions compared to the previously described implementation. The dimensioning of the protective shield 2 may be adapted as required in the design, in particular taking into account the installation space for the protection device 1 on a military vehicle 100.

The protective shield 2 is also of an angular design in this implementation and has an angular viewing window 4 adapted to the protective shield 2. The surface of the viewing window 4 ends on one side at the surface of the protective shield 2. The angular design of the viewing window 4 may be particularly advantageous if a large area of the protective shield 2 is to be transparent, because, for example, the protective shield covers a large viewing area of an optical arrangement and/or of a crew member. Alternatively, however, it is also possible to design the viewing window 4 to be flat.

The protection device 1 also has a frame 5, which is arranged on the protective shield 2. The frame 5 is irreversibly connected to the protective shield 2, for example by welding, wherein it would also be conceivable here to alternatively provide a detachable connection, for example by screws. Frame 5 surrounds a shield recess 2.1, in which the viewing window 4 is fitted. In addition, it is possible that the viewing window 4 is clamped and/or glued into the shield recess 2.1. To simplify the installation of the viewing window 4 in the shield recess 2.1, the corners of the viewing window 4 can be beveled, for example, to allow a rear grip by a fitter during assembly.

The fastening device 3 has a carrier device 7, which has two vertical supports 7.1 and a horizontal support 7.2 in the illustration. The protective shield 2 is arranged on the carrier device 7 by means of stops 7.3, which are formed as part of the vertical supports 7.1.

The fastening device 3 also has two hinges 8, which are arranged on the protective shield 2. Alternatively, however, it would also be possible to arrange the hinges 8 on the carrier device 7. In this design according to FIGS. 4*a* and 4*b*, the distanced arrangement of the hinges 8 also results in an axis A, which is the pivot axis of the hinges 8 and at the same time the pivot axis of the protective shield 2.

A difference of the protection device 1 according to FIGS. 4*a*, 4*b* compared to the previous described design according to FIGS. 3*a*, 3*b* results from the consideration of the locking elements 9 and the locking holders 10. The two locking holders 10 are fork-like, each with a fork arm, each of which has a bore, for example a threaded bore. By means of the locking holders 10, the protective shield 2 can be attached to the vehicle 100, for example, by making a screw connection between the locking holders 10 and the vehicle 100. The locking holders 10 are connected by a bridge 10.4.

The locking elements 9 are used to lock the protective shield 2 and are designed as screw bolts 9.1. The screw bolts 9.1 connect the carrier device 7 to the locking holders 10. When moving the protective shield 2 from a first position, for example the operating position, to a second position, for example the parking position, the locking of the locking elements 9 is released, so that the locking holders 10 including the bridge 10.4 remain unmoved and fixed on the vehicle 100 and the carrier device 7 is moved with the hinges 8 and the protective shield 2.

According to FIG. 4*a*, the protective shield 2 is located in the parking position. In the parking position, the protective shield 2 is attached to the vehicle 100 by means of the fastening device 3, namely both by means of the hinges 8, which are not visible in this illustration, and by means of the carrier device 7. Also according to FIG. 4*b*, in which the protective shield 2 is located in the operating position, it can be seen that the protective shield 2 is attached to the vehicle 100 by means of the fastening device 3, namely by means of the hinges 8 and the carrier device 7. For the attachment of the protective shield 2 to the vehicle 100, however, other designs are also conceivable, for example an arrangement in which the protective shield 2 without the carrier device is attached directly to the vehicle 100 by means of a hinge or in which the carrier device comprises the hinge.

Figure 5A:
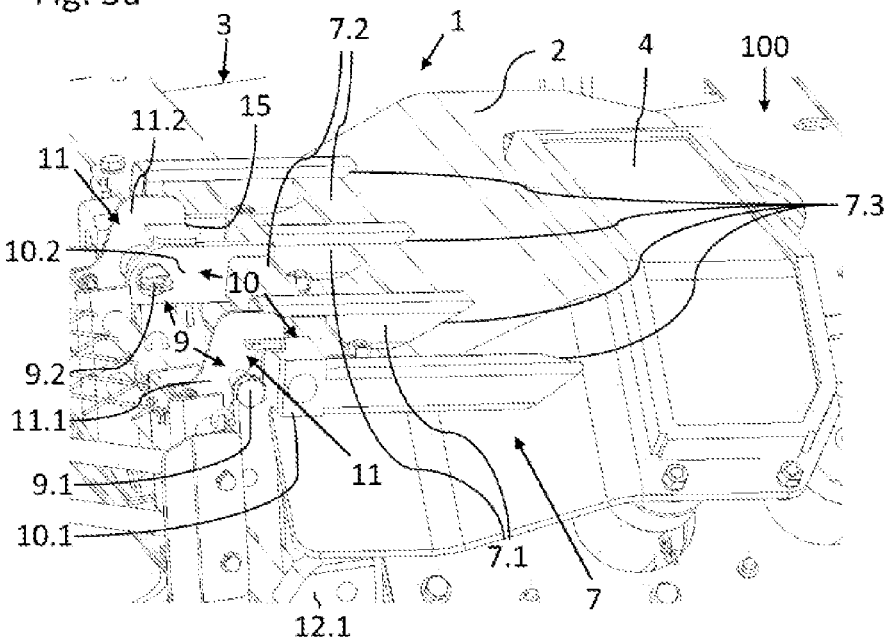
FIGS. 5*a* and 5*b* show a movable protection device attached to a vehicle in a parking position and in an operating position.
Figure 5B:
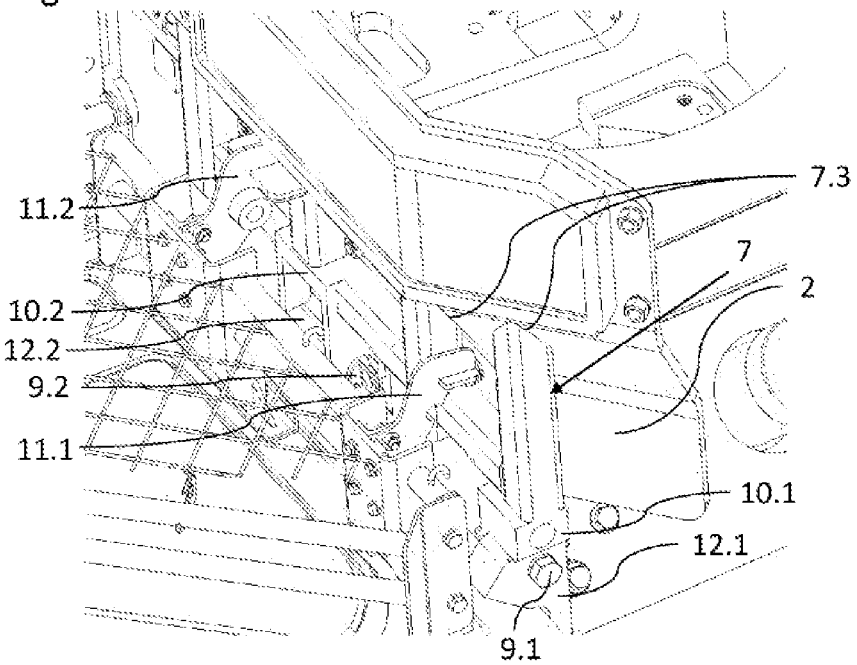

FIGS. 5*a* and 5*b* show a protection device 1 according to the invention with a protective shield 2, which is movably attached by means of a fastening device 3 to a military vehicle 100. The protection device 1 represents a third exemplary embodiment, wherein the design is essentially similar to the first two embodiments according to the preceding illustrations according to FIGS. 3 and 4. The advantages of the first two embodiments mentioned above therefore also apply to this embodiment and the following discussion will focus in particular on further features and aspects of the protection device 1.

FIG. 5*a* shows the protective shield 2 in a parking position. In the parking position, the contour of the vehicle 100 is reduced compared to an operating position as FIG. 5*b* shows. In the parking position the protective shield 2 is positioned flat to the roof of the vehicle 100, wherein different positions are also possible as a parking position.

The protective shield 2 is held in the parking position by the fastening device 3, in particular by the carrier device 7, and is locked in this position by means of the locking elements 9. The protective shield 2 is at a distance from the roof of the vehicle 100, which avoids the transmission of vibrations to the protective shield 2 via the roof. However, it would also be conceivable to rest the protective shield 2 on the roof, so that locking it in at least in one position, in particular the parking position, would not be necessary.

The locking elements 9 are inserted into the locking holders 10. The screw bolt 9.1 is screwed to the first locking holder 10.1, the bolt 9.2 is plugged into the bores of the second locking holder 10.2. It is quite advantageous here that the locking elements 9 are secured by certain measures and are thus made captive, such as by a cotter or a locking ring or the preload of a spring.

In order to lock the protective shield 2 in the parking position, two parking brackets 11 are provided on the vehicle 100. During locking, the parking brackets 11 are received by the locking holders 10, so that when the locking elements 9 are inserted, they are simultaneously plugged through the parking brackets 11. The parking brackets 11 are therefore designed to correspond to the locking elements 9 and the locking holders 10 of the protection device 1.

For the design of the parking brackets 11 it is also referred to FIG. 5*b*. Thus, the first parking bracket 11.1 has a partial bore, which cuts its outer edge, so that the shaft of the screw bolt 9.1 can be led into this partial bore without completely detaching the screw bolt 9.1 from the locking holder 10.1. If the screw bolt 9.1 is then screwed to the locking holder 10.1, a screw connection is made between the locking holder 10.1 and the parking bracket 11.1 and consequently the protective shield 2 is locked.

The second parking bracket 11.2 is provided with a bore so that the bolt 9.2 is inserted through it when it is inserted into the locking holder 10.2. Movement of the protective shield 2 is thus prevented after locking due to the locking elements 9, so that it remains in the parking position.

When choosing the locking elements 9, further combinations of screw bolt 9.1 and bolt 9.2 are also possible. For example, two screw bolts 9.1 or two bolts 9. 2 can be used as locking elements 9. The combination of screw bolt 9.1 and bolt 9.2 implemented in FIGS. 5*a* and 5*b*, however, has the advantage that bracing is achieved by the screw connection between the locking holder 10.1 and the parking bracket 11.1, so that the transmission of vibrations to the protection device 1, which can occur when driving the military vehicle 100, for example, can be reduced. Due to the screw connection, the protection device 1 is firmly fixed in the parking position, so that possible vibrations of the protection device 1 can be counteracted.

A sensor 15, which is not shown in detail, and which is designed as a position sensor and which is used to detect the different positions of the protective shield 2, is also arranged on the parking bracket 11.2. By using the sensor data, a coupling of the protection device 1 and the distance-active protection system 200 may be provided in such a way that the protection system 200, in particular the countermeasure 201, is accordingly only enabled in the operating position of the protective shield 2 and/or is accordingly blocked in the parking position of the protective shield 2. As a result, the protective effect of the protection device 1 can be additionally increased by avoiding repercussion effects R acting on the vehicle 100 while the protective shield 2 is in the parking position.

For coupling the protection device 1 and the distance-active protection system 200, the sensor data generated by the sensor 15 are transmitted to a control unit 16 which is not shown in detail, and which evaluates the sensor data accordingly and blocks or releases the distance-active protection system 200 on the basis of this sensor data. The coupling between the sensor 15 and the control unit 16 can be carried out by cable or alternatively wirelessly, in particular via a radio connection.

In this context, however, as an alternative to a separate control unit 16, it would also be possible to use an existing control unit 16 of the vehicle 100 and in particular of the distance-active protection system 200 to process the sensor data and to dispense with an additional control unit 16.

A possible arrangement of the control unit 16 is shown schematically in FIGS. 1 and 2. The control unit 16 is located in the military vehicle 100, wherein other arrangements are also possible. In addition, the control unit can also coexist with a control unit of the protection system 200.

To transfer the protective shield 2 from the parking position according to FIG. 5*a* into the operating position according to FIG. 5*b*, the locking elements 9 are released and the protective shield 2 is then moved pivotably.

For this purpose, the screw bolt 9.1 inserted in the locking holder 10.1 and the bolt 9.2 inserted in the locking holder 10.2 are loosened so that the locking holders 10 are released. In order not to lose them when loosening the locking elements 9, especially if the locking elements 9 remain partially in the locking holder 10, it is conceivable to make the locking elements 9 captive.

Once the locking elements 9 are loosened, the protective shield 2 can be moved by means of the fastening device 3, in particular by means of the hinges 8. In the exemplary embodiment, the protective shield 2 is pivoted here with the carrier device 7 by means of the hinges 8 which cannot be seen in these illustrations. The pivoting movement is carried out manually, for example by a crew member, wherein it is also possible to carry out the movement automatically, for example by a drive and/or hydraulics.

The movement of the protective shield 2 starts in the parking position according to FIG. 5*a* and ends in the operating position according to FIG. 5*b*. During the movement of the protective shield 2, the entire carrier device 7 is moved, so that the locking holders 10 arranged on the carrier device 7 including the locking elements 9 are also moved.

When the operating position according to FIG. 5*b* is reached, the protective shield 2 is locked therein by means of the locking elements 9. For locking, operational brackets 12 are provided on the military vehicle 100. These are designed to correspond to the locking elements 9 and locking holders 10, so that when inserting the locking elements 9 into the locking holders 10, a connection to the operational brackets 12 is made in each case. In this design of the protection device 1, it is thus provided that the same locking elements 9 are provided for the locking of the protective shield 2 in its different positions.

For this purpose, the first operational bracket 12.1 is provided with a bore through which the screw bolt 9.1 is inserted during locking. By screwing the screw bolt 9.1 to the locking holder 10.1, a connection, in this case a screw connection, is made between the locking holder 10.1 and the operational bracket 12.1 or the vehicle 100. With the screw connection, the aforementioned advantages arise in terms of vibration reduction.

The bolt 9.2 is inserted through the second operational bracket 12.2 into the locking holder 10.2. The operational bracket 12.2 also has a bore for this and can be designed similarly or identically to the first operational bracket 12.1.

In contrast to the parking brackets 11, the operational brackets 12 are of a more solid design, since when using a distance-active protection system 200, at least part of its repercussions R can also be transferred to the operational brackets 12 via the protective shield 2 and the carrier device 7.

In FIG. 5*b*, which illustrates the operating position of the protective shield 2, the protective shield 2 is positioned in a raised position relative to the vehicle 100. The protective shield 2 is positioned in such a way that objects of the vehicle 100 behind it are protected against repercussions R of the distance-active protection system 200, which is not illustrated in more detail.

In order to additionally support the protection device 1 in the operating position, the design according to FIGS. 5*a* and 5*b* provides that the parking brackets 11 support the protective shield 2. For this purpose, the parking brackets 11 rest against the erect protective shield 2. Alternatively, however, it would also be conceivable that the parking brackets 11 rest against the carrier device 7, in particular its supports 7.1, 7.2.

A fourth exemplary embodiment of a protection device 1 according to the invention is shown in FIGS. 6*a* and 6*b*. The protection device 1 has an angular protective shield 2, which is movably attached by means of a fastening device 3 to a military vehicle 100. The design of this exemplary embodiment is also similar to the previous implementations, so that the advantages mentioned also apply to this implementation. In the following, therefore, primarily further features and aspects are discussed.

FIG. 6*a* represents the protective shield 2 in a parking position. The protective shield 2 is located flat relative to the vehicle 100 and thus reduces the vehicle contour in an advantageous manner.

In a difference from the previous designs, two hinges 8 are arranged directly on the protective shield 2 and thus allow a pivoting movement of the protective shield 2 around an axis A, which passes through the hinges 8. Since the pivot points of the hinges 8 are at different distances from the roof of the vehicle 100, the axis A is oriented at an angle relative to the roof of the vehicle 100. The orientation of the axis A results from the arrangement of the hinges 8 on the shield 2 and the vehicle 100. By an appropriate design and arrangement of the hinges 8, it is possible to adapt the orientation of the axis A, in particular to the installation space and/or the intended use of the protection device 1.

In order to carry the protective shield 2, the fastening device 3 of the protection device 1 also has a carrier device 7 in this design. The carrier device 7 is similar to the implementation according to FIGS. 4*a*, 4*b* and comprises supports 7.1, 7.2.

The fastening device 3 also has two locking elements 9 according to the type of the screw bolt 9.1 and two locking holders 10 connected via a bridge 10.4. In a difference from the previously described design according to FIGS. 5*a* and 5*b*, the captive screw bolts 9.1 are used for the connection between the carrier device 7 and the locking holders 10 in the operating position and not the connection between the locking holders 10 and the parking brackets 11 or operational brackets 12. The connection between the vehicle 100 and the locking holders 10 is realized by means of four screw bolts 14.

The locking holders 10 each have a bore for receiving the locking elements 9. In one of the bores, a sensor 15 is provided for detecting the different positions of the protective shield 2. This sensor 15 is designed as a switch in accordance with FIGS. 6*a* and 6*b*, wherein different types of sensors can be used. Different arrangements of the sensor 15 are also possible. The sensor data of the sensor 15 are transmitted to a control unit 16 and processed as described above.

Due to the design of the protection device 1 according to FIGS. 6*a* and 6*b*, when the protective shield 2 is moved, the carrier device 7 is moved with it and the locking holders 10 and the bridge 10.4 connecting the locking holders 10 remain fixed on the vehicle 100.

Furthermore, only the locking of the protective shield 2 in the operating position, as shown in FIG. 6*b*, is undertaken by the locking elements 9, whereas the protective shield 2 is locked in the parking position by a locking connector 13.

For locking the protective shield 2 in the parking position according to FIG. 6*a*, therefore, a locking holder 10.3 is additionally provided on the protective shield 2. The locking holder 10.3 has a bore, which can then accommodate a bolt 13.1 of the locking connector 13, so that the protective shield 2 is locked. Furthermore, it is also conceivable to alternatively provide the bore of the locking holder 10.3 with a thread, so that a screw bolt can be accommodated for locking. Furthermore, it is possible to equip the protective shield 2 with further locking holders 10.3, whereby, for example, vibrations can be reduced.

In the exemplary embodiment, in the parking position the distance between the protective shield 2 and the roof of the vehicle 100 is bridged by means of the locking connector 13. The locking connector 13 has a middle connector 13. 2, which can be adjusted in length by screwing in and out and at each end of which a holder 13.3 is arranged. Bolts 13.1 for locking the protective shield 2 are accommodated by means of the holders 13.3. The bolts 13.1 may be designed as simple plug-in bolts or as spring bolts, wherein a captive design is advantageous.

To lock the protective shield 2 in the parking position according to FIG. 6*a*, one end of the locking connector 13 remains connected to the vehicle 100 and the second end is connected to the locking holder 10.3, so that the bolt 13.1 locks the protective shield 2.

FIG. 6*b* illustrates the protective shield 2 in the operating position. The protective shield 2 is locked by means of screw bolts 9.1 by the screw bolts 9.1 connecting the carrier device 7 to the locking holders 10. The locking holders 10 have corresponding bores, which are illustrated in FIG. 6*a*.

The carrier device 7 is connected to the locking holders 10 by means of the locking elements 9 in the operating position of the protective shield 2, so that occurring repercussions R of a distance-active protection system 200, which is not shown, are absorbed by the protective shield 2 and dissipated via the fastening device 3.

The locking connector 13 remains on the vehicle 100 in the operating position of the protective shield 2, wherein it is also conceivable to arrange the locking connector 13 or a part of the locking connector 13, in particular the bolt 13.1, on the protective shield 2 in the operating position.

Figure 7:
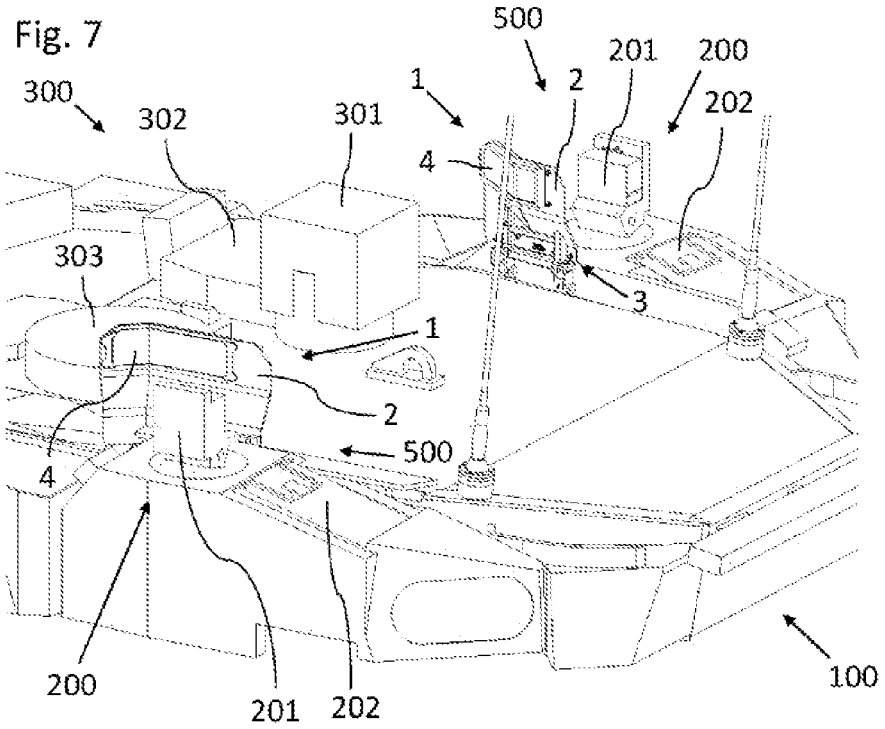
FIG. 7 shows a partial representation of the military vehicle with two protection devices according to the invention in an oblique view and FIGS. 8*a* and 8*b* each show a partial representation of the military vehicle with the two protection devices according to FIG. 7 in the parking position in an oblique view.

FIG. 7 shows a military vehicle 100 with distance-active protection systems 200. To protect against repercussions R, two protection devices 1 are arranged near each outer side of the vehicle 100 on its turret. Alternatively, however, it is also possible to place the protection device 1 elsewhere in the vehicle 100. For example, the protection device 1 could also be arranged directly on the hull or in the middle of the turret of the vehicle 100. Furthermore, an arrangement on the roof or on the side walls of a vehicle is possible. The protection device 1 should be located on the outer contour of the vehicle.

The protection device 1 shown in the upper part of the illustration corresponds to the design according to FIGS. 6*a* and 6*b*, wherein the protection device 1 shown in the lower part of the illustration corresponds to the design of FIGS. 5*a* and 5*b*. The advantages discussed above result for the protection devices 1.

The protection devices 1 and the distance-active protection systems 200 are components of a defense system 500 according to the invention. Here, the protection devices 1 are used to protect against repercussions R of the distance-active protection systems 200 and are therefore arranged on the vehicle 100 in such a way that they each lie on a line between the distance-active protection system 200 and the objects to be protected 300, in particular optics 301 and hatches 302, 303. It follows that the protective shields 2 of the protection devices 1 cover an area of the vehicle 100 which is protected from the repercussions R. In this context, it is conceivable to adapt the protective shield 2 to the available installation space on the vehicle 100. This adaptation can also be made directly in situ, for example by extending the protective shield 2 by welding and/or bolting on.

In this context, it is also possible that a defense system 500 according to the invention has only one protection device 1 and one distance-active protection system 200 or alternatively a plurality of these.

Furthermore, the protection devices 1 according to FIG. 7 are arranged on the vehicle 100 in such a way that the protective shields 2 would be pivoted out of the field of view of the crew members, who are, for example, in the hatches 302, 303, and/or of the optics 301, when moving from the illustrated operating position to the parking position. In order not to significantly reduce the field of view of the crew members and/or optics 301 even in the operating position of the protective shield 2, as shown in FIG. 7, a viewing window 4 is provided in each protective shield 2.

The distance-active protection system 200 has a countermeasure 201 and a loading device 202, wherein the countermeasure 201 is rotatable. With an approaching threat 400, the countermeasure 201 turns towards the approaching threat 400 and shoots at it, causing repercussions R which act towards the vehicle 100. The repercussions R are absorbed and diverted by the protection devices 1, in particular their protective shield 2, so that the vehicle 100, in particular its objects which are to be protected 300, is protected.

In this context, it is also possible that the distance-active protection system 200 is coupled to the protection device 1 in such a way that the distance-active protection system 200 can only be used if the protective shield 2 is in the operating position. Thus, it could be prevented that repercussions R occur while the protective shield 2 is in the parking position by blocking the distance-active protection system 200 in the parking position and releasing it in the operating position.

Outside of operations, the protective shield 2 can be moved from the illustrated operating position to a parking position, which are shown in FIGS. 8*a* and 8*b*. FIG. 8*a* shows the protection device 1 shown in the upper area of FIG. 7 in the parking position, FIG. 8*b* shows the protection device 1 shown in the lower area of FIG. 7 in the parking position.

To transfer the protective shields 2 from the operating position to the parking position shown, the countermeasure 201 of the distance-active protection system 200 is dismounted and the protective shield 2 is moved according to the previous description. According to FIGS. 8*a* and 8*b*, at least part of the distance-active protection system 200, in particular the loading device 202, can remain on the vehicle, so that the protective shield 2 in the parking position serves as a kind of lid for the distance-active protection system 200. However, it would also be conceivable here not to dismount the countermeasure 201 and to design the protective shield 2 in such a way that it serves as a lid for the entire distance-active protection system 200 in the parking position, and in particular for the countermeasure 201.

In the embodiments of the protection devices 1, it is provided that the movement into the different positions of the respective protective shield 2 is carried out manually by a crew member. It would also be conceivable here to provide a motor which moves the protective shield 2. The protective shields 2 are pivoted outwards relative to the vehicle 100 when moving from the operating position to the parking position, so that the contour of the vehicle 100 is reduced.

REFERENCE CHARACTERS

1 Protection device
2 Protective shield
2.1 Shield recess
3 Fastening device
4 Viewing window
5 Frame
6 Screws
7 Carrier device
7.1 Vertical support
7.2 Horizontal support
7.3 Stop
8 Hinge
9 Locking element
9.1 Screw bolt
9.2 Bolt
10 Locking holder
10.1 First locking holder
10.2 Second locking holder
10.3 Third locking holder
10.4 Bridge
11 Parking bracket
11.1 First parking bracket
11.2 Second parking bracket
12 Operational bracket
12.1 First operational bracket
12.2 Second operational bracket
13 Locking connector
13.1 Bolt
13.2 Connector
13.3 Holder
14 Screw bolt
15 Sensor
16 Control unit
100 Military vehicle
200 Distance-active protection system
201 Countermeasure
202 Loading device
300 Object to be protected
301 Optical system
302 First hatch
303 Second hatch
400 Threat
500 Defensive System
B Bombardment
R Repercussions

What is claimed is:

1. A defense system with a distance-active protection system for the protection of a military vehicle and a protection device for the military vehicle for protection against repercussions of the distance-active protection system on the vehicle, the protection device comprising:

a protective shield, which is pivotally attached to the vehicle by a fastening device, wherein the distance-active protection system is coupled to the protection device such that the distance-active protection system can only be used in an operating position.

2. A defense system as claimed in claim 1, wherein the protective shield is movable between a parking position and an operating position.

3. A defense system as claimed in claim 1, further comprising a locking element that locks the protective shield in different positions on the vehicle.

4. A defense system as claimed in claim 1, wherein the protective shield has a viewing window for looking through the protective shield.

5. A defense system as claimed in claim 4, wherein the viewing window is replaceably arranged in the protective shield.

6. A defense system as claimed in claim 4, wherein the viewing window includes vibration protection for protection of the viewing window against vibrations.

7. A defense system as claimed in claim 1, wherein the protective shield is of angular design for deflection of the repercussions of the distance-active protection system.

8. A defense system as claimed in claim 1, further comprising at least one stop that, in the event of repercussions of the distance-active protective systems, absorbs at least a part of the repercussions.

9. A defense system as claimed in claim 2, further comprising at least one sensor that detects at least one position of the protective shield, selected from the parking position and the operating position.

10. A defense system as claimed in claim 9, further comprising a control unit for processing sensor data from the sensor.

11. A defense system with a distance-active protection system for the protection of a military vehicle and a protection device for the military vehicle for protection against repercussions of the distance-active protection system on the vehicle, the protection device comprising:

a protective shield, which is pivotally attached to the vehicle by a fastening device, wherein the protective shield, when in a parking position, is positioned adjacent to and covers the distance-active protection system.

12. A military vehicle characterized by a defense system as claimed in claim 1.

13. The military vehicle as claimed in claim 12, wherein the protective shield is arranged on a line between the distance-active protection system and an object which is to be protected of the military vehicle.

14. A method for protection against repercussions of a distance-active protection system on a military vehicle with a protection device, of a defense system as claimed in claim 1, the method comprising a pivotal movement of the protective shield.

15. The method as claimed in claim 14, further comprising moving the protective shield into an operating position for shooting the distance-active protection system.

16. The defense system as claimed in claim 1, wherein the protective shield extends to a part of the distance-active protection system remaining when a countermeasure of the distance-active protection system is dismounted.

17. The method as claimed in claim 14, wherein a countermeasure of the distance-active protection system is dismounted and wherein protective shield is moved into a parking position in which it covers the remaining part of the distance-active protective system.

* * * * *